US010646922B2

(12) United States Patent
Kronberger

(10) Patent No.: US 10,646,922 B2
(45) Date of Patent: May 12, 2020

(54) METHOD AND DEVICE FOR PRESSING A GREEN COMPACT

(71) Applicant: Miba Sinter Austria GmbH, Laakirchen (AT)

(72) Inventor: Christian Kronberger, Vorchdorf (AT)

(73) Assignee: Miba Sinter Austria GmbH, Laakirchen (AT)

( * ) Notice: Subject to any disclaimer, the term of this patent is extended or adjusted under 35 U.S.C. 154(b) by 538 days.

(21) Appl. No.: 14/726,914

(22) Filed: Jun. 1, 2015

(65) Prior Publication Data

US 2015/0367414 A1 Dec. 24, 2015

(30) Foreign Application Priority Data

Jun. 18, 2014 (AT) ..... 50425/2014

(51) Int. Cl.

*B22F 5/10* (2006.01)
*B22F 3/02* (2006.01)
*B22F 3/03* (2006.01)

(52) U.S. Cl.

CPC ..... *B22F 3/03* (2013.01); *B22F 3/02* (2013.01); *B22F 5/10* (2013.01); *B22F 2003/033* (2013.01); *B22F 2207/17* (2013.01); *Y10T 428/12014* (2015.01)

(58) Field of Classification Search

None

See application file for complete search history.

(56) References Cited

U.S. PATENT DOCUMENTS 3,664,785 A 5/1972 Marshall et al.
4,963,320 A * 10/1990 Saito ..... B22F 3/02 148/101
7,553,145 B2 6/2009 Nies et al.
2006/0008376 A1 1/2006 Olsson (Continued)

FOREIGN PATENT DOCUMENTS

CN 102762321 10/2012
CN 103521772 A 1/2014

(Continued)

OTHER PUBLICATIONS

JP H06-295836 machine translation (Year: 1994).*

(Continued)

*Primary Examiner* — Paul A Wartalowicz
*Assistant Examiner* — Stephani Hill
(74) *Attorney, Agent, or Firm* — Collard & Roe, P.C.

(57) ABSTRACT

The invention relates to a method for pressing a green compact (1) for producing a sintered molded part from a sintering powder, according to which the sintering powder is filled into a mold cavity (43*a*) of a die (43), and then the sintering powder is pressed by at least one punch, which is pushed at least partly into the mold cavity (43*a*), to form a green compact (1), wherein to form an undercut in the green compact (1) a portion of the sintering powder is pushed by a punch out of a first plane of the die (43) by forming an opening (11) in the first plane in pressing direction into a second plane of the die (11) different from the first plane. The invention also relates to a device (12) for performing said method and a correspondingly produced sintered molded part.

2 Claims, 6 Drawing Sheets

(56) References Cited

U.S. PATENT DOCUMENTS

| | | | | |
|---|---|---|---|---|
| 2006/0131775 | A1* | 6/2006 | Hicklen | B22F 3/03 264/109 |
| 2006/0257279 | A1* | 11/2006 | Ishijima | B22F 5/10 419/37 |
| 2008/0298996 | A1 | 12/2008 | Kuplen et al. | |
| 2012/0118104 | A1 | 5/2012 | Gurosik et al. | |
| 2012/0216654 | A1 | 8/2012 | Schmitt et al. | |

FOREIGN PATENT DOCUMENTS

| | | | | |
|---|---|---|---|---|
| DE | 94 08 317 | U1 | | 7/1994 |
| DE | 195 08 952 | A1 | | 9/1996 |
| DE | 10 2005 027 032 | A1 | | 12/2006 |
| EP | 2 098 317 | A1 | | 9/2009 |
| JP | S51-149106 | A | | 12/1976 |
| JP | S61-104005 | A | | 5/1986 |
| JP | S64-31902 | A | | 2/1989 |
| JP | H06295836 | A | * | 10/1994 |
| JP | 2002-241804 | A | | 8/2002 |
| JP | 2009-256723 | A | | 11/2009 |
| JP | 2010-007154 | A | | 1/2010 |
| WO | WO0105541 | | * | 1/2001 |

OTHER PUBLICATIONS

Oxford English Dictionary definition of “breakthrough” (Year: 2019).*
Oxford English Dictionary definition of “opening” (Year: 2019).*
Oxford English Dictionary definition of “open” (Year: 2019).*

* cited by examiner

METHOD AND DEVICE FOR PRESSING A GREEN COMPACT

CROSS REFERENCE TO RELATED APPLICATIONS

Applicant claims priority under 35 U.S.C. § 119 of Austrian Application No. A 50425/2014 filed on Jun. 18, 2014, the disclosure of which is incorporated by reference.

The invention relates to a method for pressing a green compact for producing a sintered molded part from a sintering powder, according to which the sintering powder is filled into a mold cavity of a die and then the sintering powder is compressed into a green compact by at least one punch which is pushed at least partly into the mold cavity.

Furthermore, the invention relates to a device for pressing a green compact from a sintering powder for a sintered molded part, with a die which has a mold cavity for receiving the sintering powder to be compressed and with a punch which has a pressing surface which can be brought into contact with the sintering powder to be pressed, wherein the punch comprises at least one first punch part and at least one second punch part.

In addition, the invention relates to a sintered molded part with at least one under-cut.

Metal components with a complex geometry are currently often produced by power-metallurgical methods for reasons of cost. It is known to press a green compact from a sintering powder which is then sintered and if necessary calibrated. The pressing is performed in a die with an upper punch and a lower punch, wherein depending on the mobility of the punch the pressing is performed uniaxially or biaxially. As the die is designed to be closed peripherally the production of radial undercuts represents a problem as the green compact can no longer be ejected after pressing unless additional structures are provided on the die. To produce radial undercuts the green compacts or the finally sintered molded parts are therefore often machined afterwards.

However, presses are also known from the prior art by means of which such radial undercuts are already formed in the press. Thus for example DE 94 08 317 U1 describes a device for producing press parts from metal powder with at least one undercut perpendicular to the pressing direction, consisting of a pressing device with at least one movable punch and a die, wherein the die has two or more jaws movable perpendicular to the pressing direction, at least one of which has a recess on the pressing surface. The undercut is formed by shaping a one-piece pressed blank into the finished part by an additional pressing process. Thus an additional pressing step is necessary which is associated with a corresponding increase in cost of the sintered molded part.

Similarly DE 195 08 952 A1 describes a die, in which segment slides are moved by the tangential displacement of segment pistons into the end position in which they project so far into the powder column in the cavity as required to produce the undercut. The upper punch is then moved downwards so that on the one hand the powder column in the cavity is compacted from above and on the other hand is compacted from below by the opposite lower punch. Afterwards the segment slides are moved back into their initial position by tangentially sliding back the segment piston. In this way the green compact can be shaped by the pressure from the upper punch with the downwards movement of the die and then ejected by the lower punch. The undercut is thus formed in one method step however the die is designed to be relative.

In principle it is also possible that the die itself is opened to eject the green compact, whereby at least a two part die is necessary which has the partition in pressing direction. The disadvantage of this is that because the green compact adheres to the pressing surfaces breaks often occur in the green compact.

The underlying objective of the present invention is to produce a sintered molded part with at least one radial undercut.

Said objective is achieved in the aforementioned method in that to form an under-cut in the green compact a portion of the sintering powder is pushed by a punch from a first plane of the die by forming an opening in the first plane in pressing direction into a second plane of the die different from the first plane.

Furthermore, the objective of the invention is achieved with the aforementioned device in that the second punch part projects over the pressing surface of the punch in the direction of the mold cavity.

In addition, the objective of the invention is achieved with the aforementioned sintered molded part in that the sintered molded part is produced according to the method and the undercut is produced without subsequent machining, wherein the undercut comprises a web which extends in a first direction and wherein at one end of the web an angled part is formed which extends in a second direction orthogonal to the first direction, and wherein also the sintered molded part has at least one opening which is spaced apart from the angled part in the first direction, wherein the opening as viewed in the first direction has a cross-sectional area which is at least approximately the same size and has at least approximately the same shape as the cross-sectional area of the angled part in said first direction.

It is an advantage that the movement of the punch parts to form the undercut is performed only in one direction, namely the pressing direction. Thus it is not necessary to have tangential slides etc. and the die can be designed to be structurally simpler. In particular, no additional devices for generating pressure are necessary as the sintering powder is displaced by the die itself. It is thus possible to produce the undercut in only a single movement, i.e. in only one movement direction and compact the sintering powder. Furthermore, the advantage here is that the sintered molded part is less heavy than sintered molded parts produced in a conventional manner with the same geometry, as the production of the undercut is associated with the formation of an opening, and thus a corresponding amount of sintering powder can be saved.

According to one embodiment variant of the method the amount of sintering powder pushed into the second plane is compacted to a greater degree than the remaining amount of sintering powder. The green compact thus has a higher green compact density in the region of the undercut and thus also a greater strength. In this way the demolding of the green compact can be improved in that breaks in the material during the demolding can be avoided more effectively. Furthermore, the finished sintered molded part can also be stronger in the area of the undercut.

To improve the slidability of the sintering powder the sintering powder can be supported only from below at least when starting to slide the amount of sintering powder.

According to one embodiment variant of the device the second punch part can be fixed in the first punch part. In this way with only one movement of the punch the powder can be displaced and also the sintering powder can then be compacted into a green compact.

However, it is also possible to adjust the second punch part relative to the first punch part. On the one hand in this way the width of the undercut can be adjusted in pressing direction so that a plurality of different sintered molded parts can be produced by means of the device. On the other hand in this way the projection of the second punch part over the pressing surface can be reduced when dipping into the sintering powder, whereby the precision of the form of the sintered molded part can be improved in that there is less of a risk that the second punch part will warp when dipping into the sintering powder because of unforeseeable resistance and that the undercut has an incorrect form.

For a better understanding of the invention the latter is explained in more detail with reference to the following figures.

In a much simplified, diagrammatic view.

Figure 1:
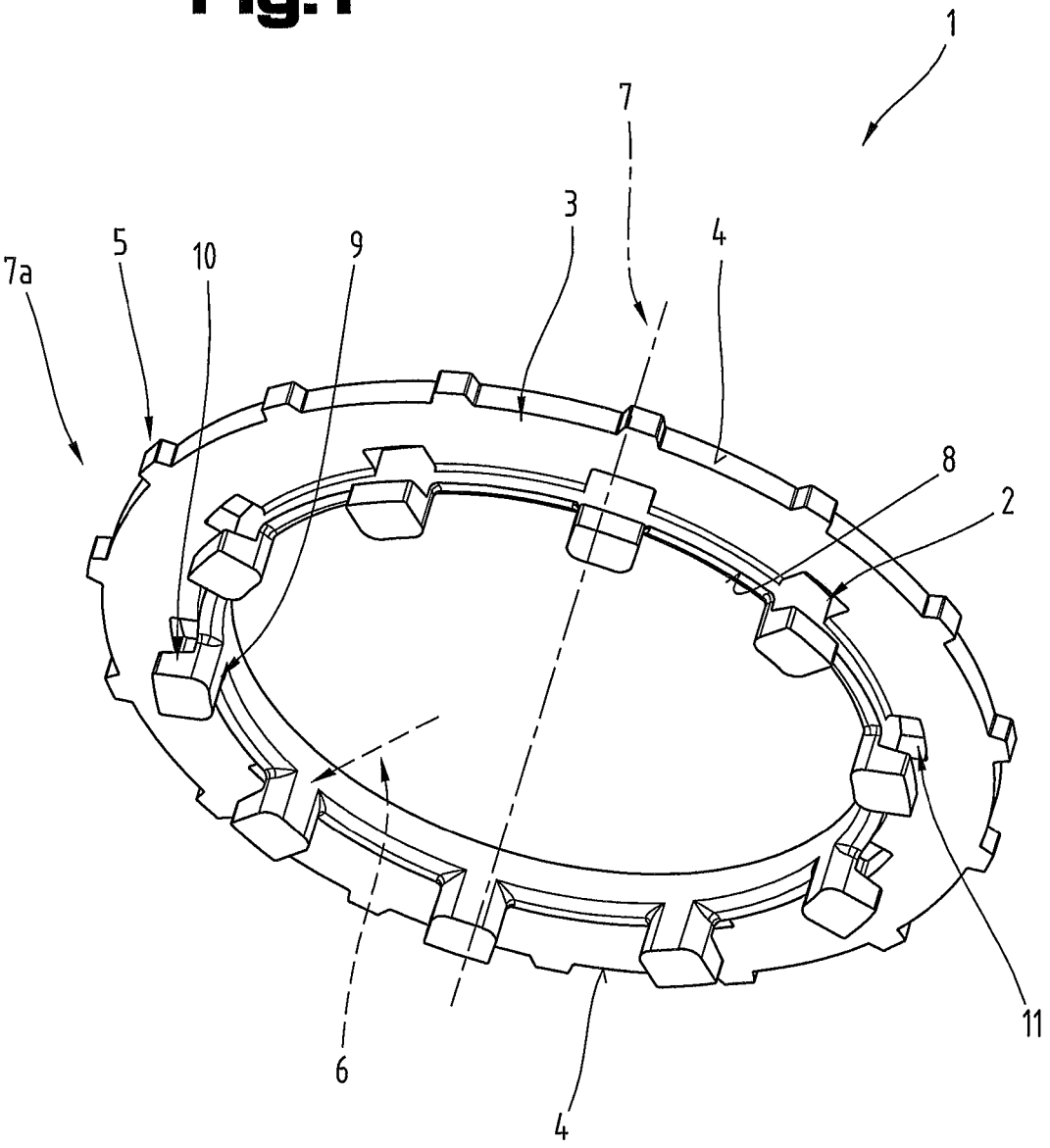
FIG. 1 shows a green compact for producing a sintered molded part in oblique view.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position.

FIG. 1 shows a green compact 1 in oblique view.

A green compact 1 is defined in the present invention as a molded part pressed from a sintering powder in the stage immediately after pressing the sintering powder in a suitable press and prior to sintering, as referred to generally in current technical language. The green compact 1 is thus a blank from which the (finished) product is produced by sintering.

Sintering methods (powder-metallurgical methods) for producing sintered components are described sufficiently in the prior art and reference is made to the latter to avoid repetition. It should only be mentioned that said methods usually comprise the steps of powder pressing and sintering. Additional method steps can be added upstream (powder mixing) or downstream (calibrating, post-processing, etc.).

The green compact 1 has at least approximately the shape of the finished sintered molded part. The term "at least approximately" means that changes in dimension during the sintering of the green compact 1 are usually taken into consideration. Preferably, the green compact 1 has a near net-shape or net-shape quality.

The green compact 1 is designed in the form of a so-called pressure plate for a lamellar package of a lamellar transmission. It should be noted that this special form is only one (preferred) embodiment of the green compact 1. Within the scope of the invention other forms of the green compact 1 are possible as long as they have at least one undercut 2 formed according to the method of the invention or by means of the device according to the invention, which is explained in more detail in the following.

The green compact 1 has a base body 3 which is designed in particular in the form of a circular ring. On the base body 3 on a radially outer end face 4 a plurality of cams 5 or teeth are distributed, in particular uniformly, around the periphery of the base body 3, which project from the end face 4 in radial direction 6 outwardly over the base body 3.

A ring-like web, in particular an annular web 7*a* is arranged extending in axial direction 7 on the base body 3. The ring-like web, in particular the annular web 7*a*, on an axial end face 8 comprises a plurality of projections 9 which are also distributed preferably evenly around the circumference of the web. The projections extend in axial direction 7. At the end of the projections angled parts 10 (arms) are formed which extend outwardly in radial direction 6, so that on the one hand the projections have an L-shaped cross-section and on the other hand undercuts 2 are formed.

The inner circumference of the green compact 1 is preferably free of projections, etc.

As viewed in axial direction 7 in an alignment of the angled parts 10 in the base body 3 openings 11 are formed, one opening 11 being provided for each angled part 10. Each of the openings 11 has a cross-sectional area which, viewed in axial direction 7, has at least approximately, in particular exactly, the same shape and size as the cross-sectional area of the angled parts 10 in axial direction 7. The reason for this is explained in more detail in the following.

The undercuts 2 are formed during the pressing of the sintering powders to produce the green compact 1 and are not processed by machine afterwards, i.e. produced by cutting processes.

Generally, the green compact 1, and thus also the sintered molded part produced therefrom, has at least one undercut area, i.e. at least one undercut 2, the undercut being produced without machine processing, wherein the undercut has a web which extends in a first direction, and wherein at one end of the web an angled part 10 is formed which extends in a second direction orthogonal to the first direction. Furthermore, the green compact 1 generally comprises at least one opening 11, which is formed in the first direction spaced apart from the angled part 10, whereby the opening 11 as viewed in the first direction has a cross-sectional area which is at least approximately the same size and has at least approximately the same shape as the cross-sectional area of the angled part 10 viewed in this first direction.

The first direction is the radial direction 6 in the example embodiment of the green compact 1 according to FIG. 1. The second direction is the axial direction 7 in the example embodiment of the green compact 1 according to FIG. 1.

The fact that the cross-sectional area of the opening is at least approximately the same size and has at least approximately the same shape as the cross-sectional area of the angled part 10 viewed in this first direction means in the finished sintered component 1 that, as a result of the sintering depending on the composition of the sintering powder from which the sintered component is produced, the green compact 1 can increase in size so that the cross-sectional areas are no longer 100% the same. For example, this may be the case if the sintering powder contains chromium.

The green compact 1 is designed in one piece.

Figure 3:
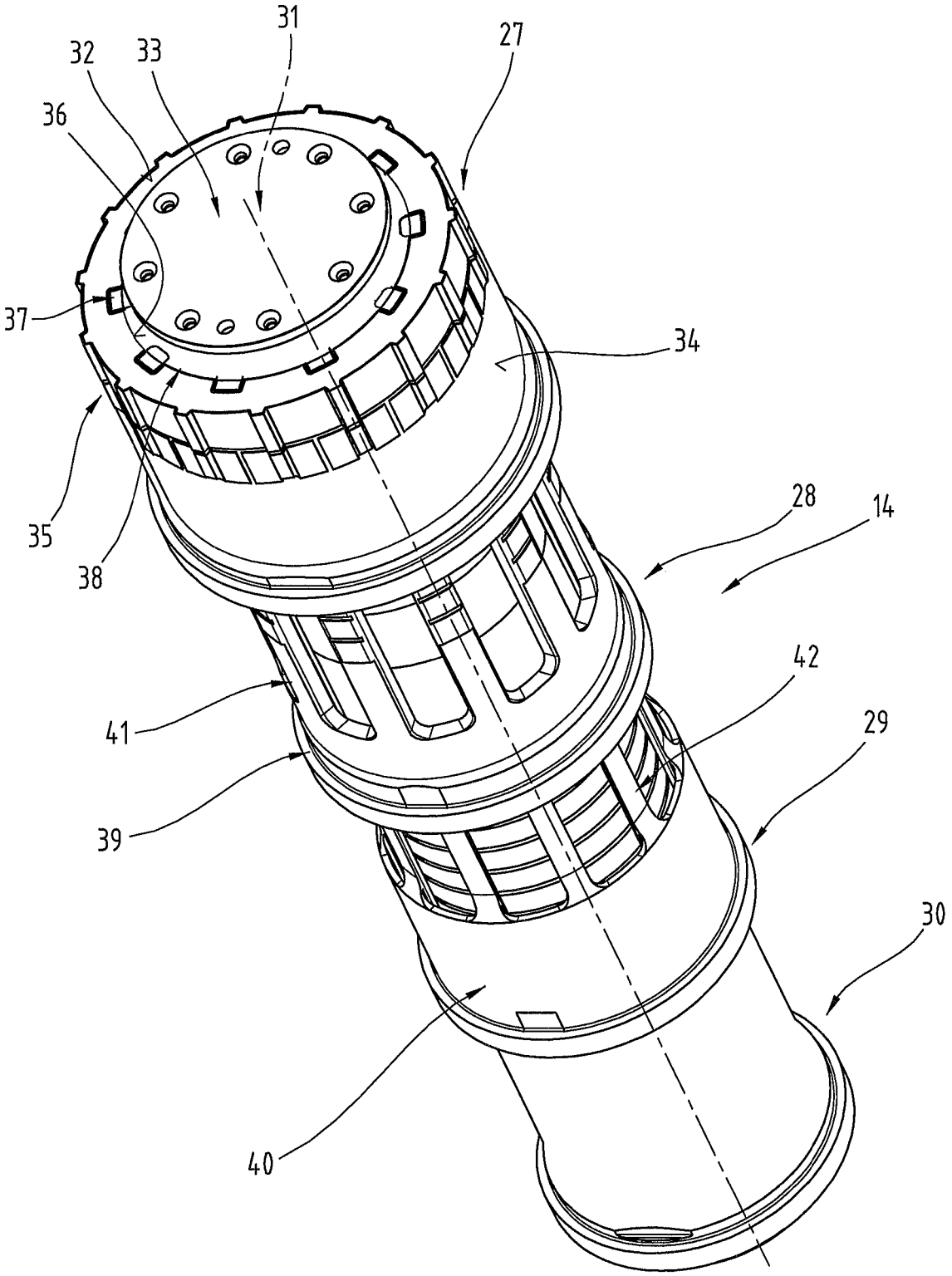
FIG. 3 shows a lower punch in oblique view.
Figure 4:
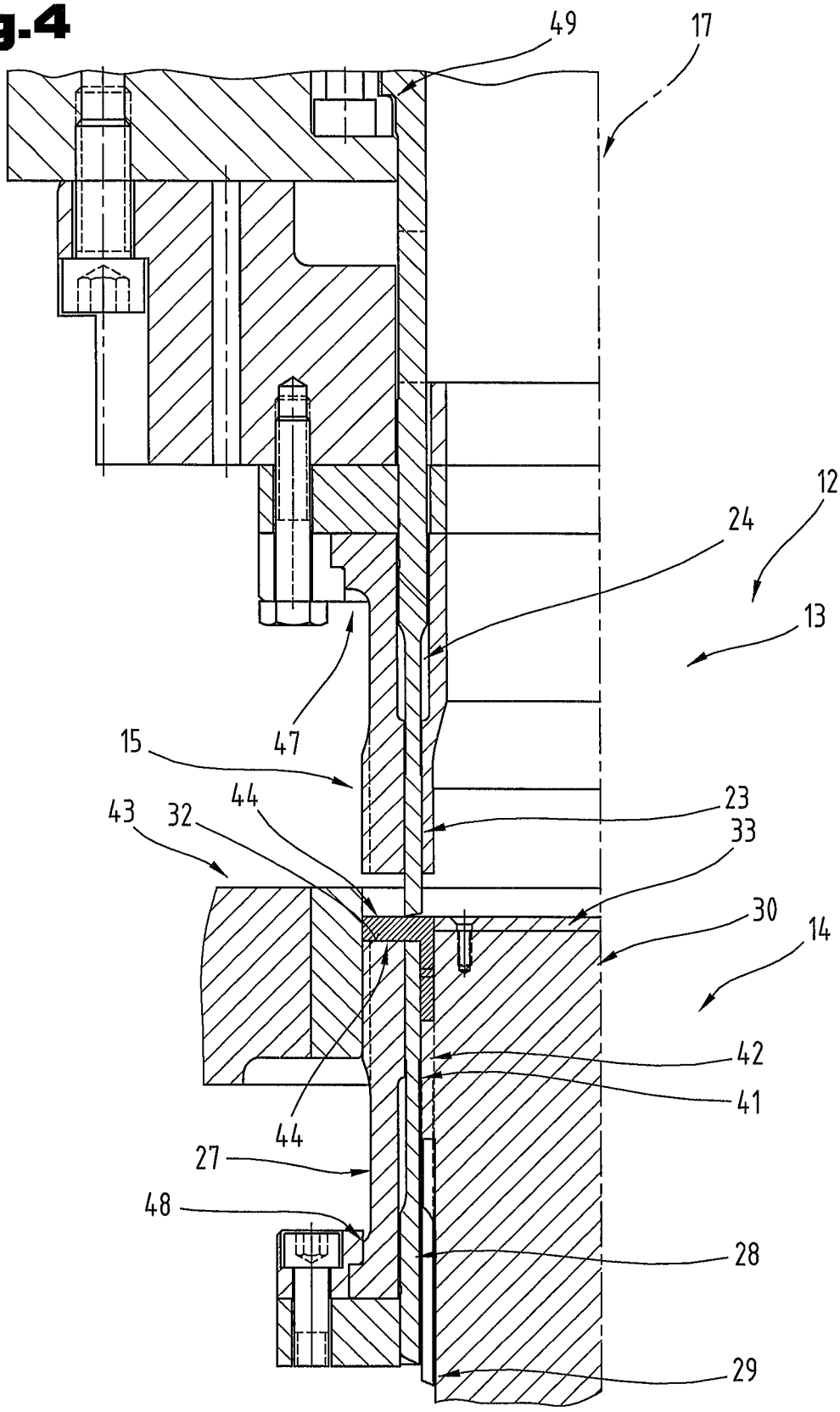
FIG. 4 shows a section of a device for pressing a green compact in a position prior to the displacement of a portion of the sintering powder.
Figure 5:
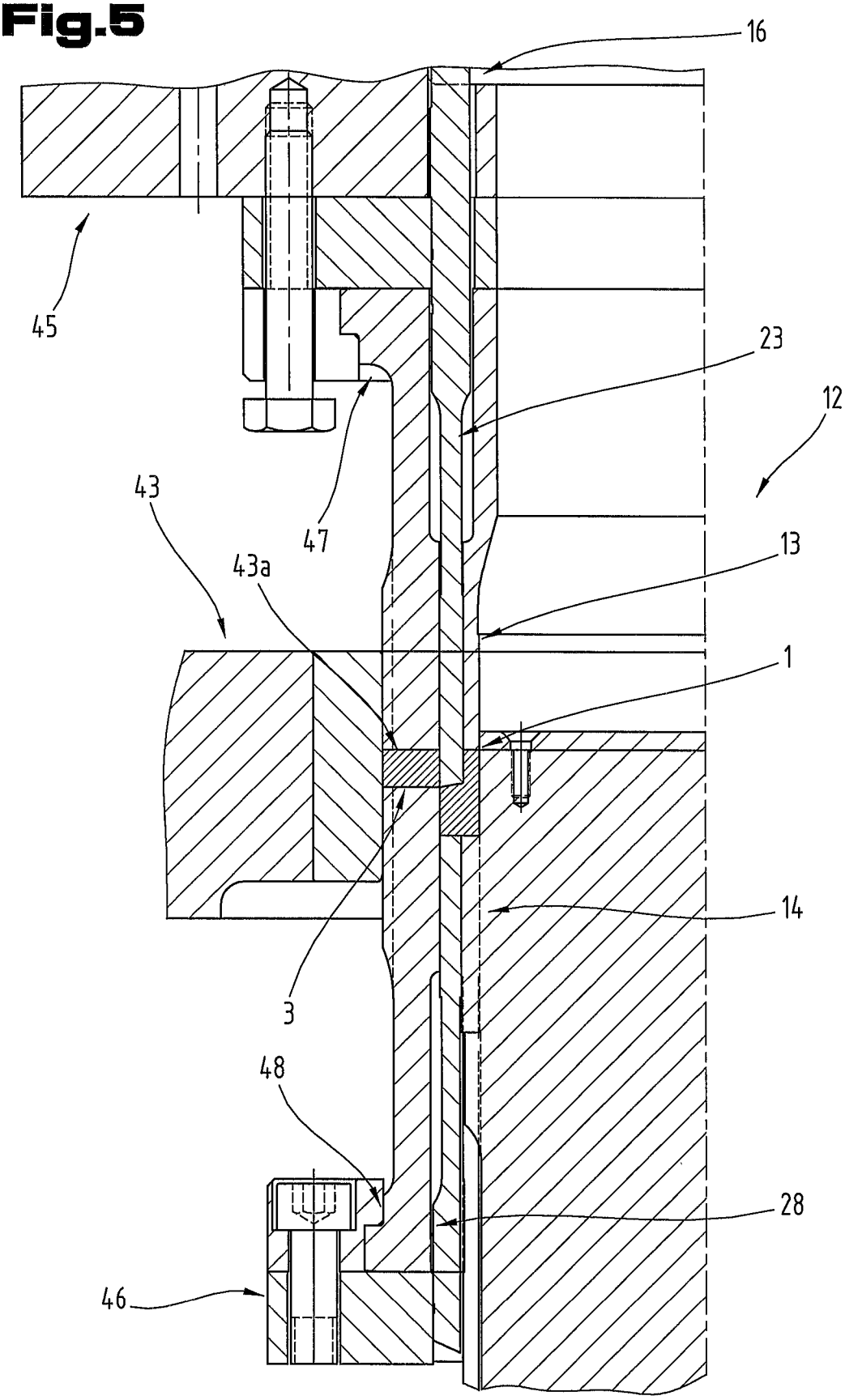
FIG. 5 shows a section of a device for pressing a green compact in a position during the displacement of a portion of the sintering powder.
Figure 6:
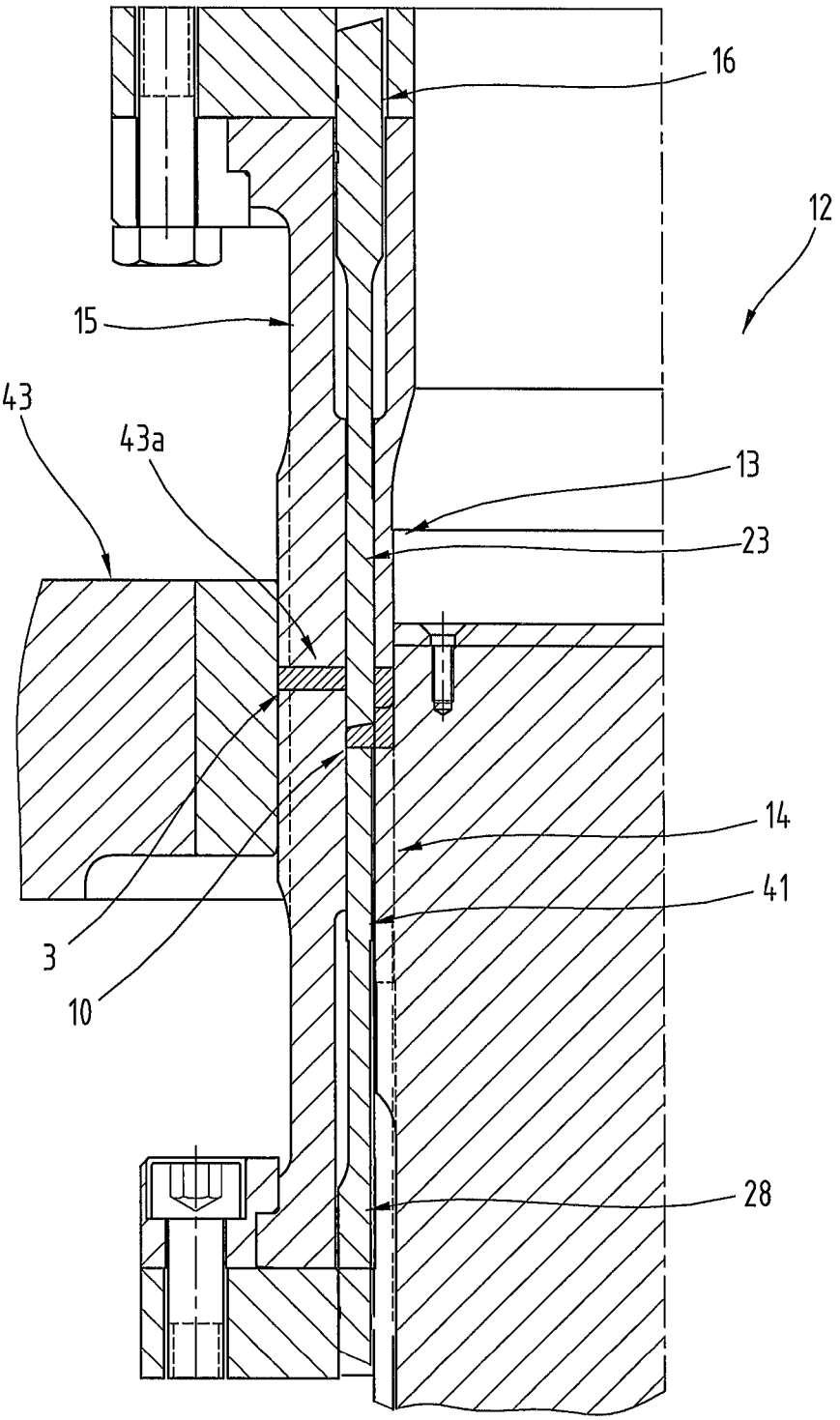
FIG. 6 shows a section of a device for pressing a green compact in a position after the displacement of a portion of the sintering powder.

To produce the green compact 1 a device 12 can be used for pressing the green compact 1 from a sintering powder, as shown in sections in FIGS. 4 to 6. Said device 12 comprises an upper punch 13 and a lower punch 14, which can be seen better in FIG. 2 or 3.

Figure 2:
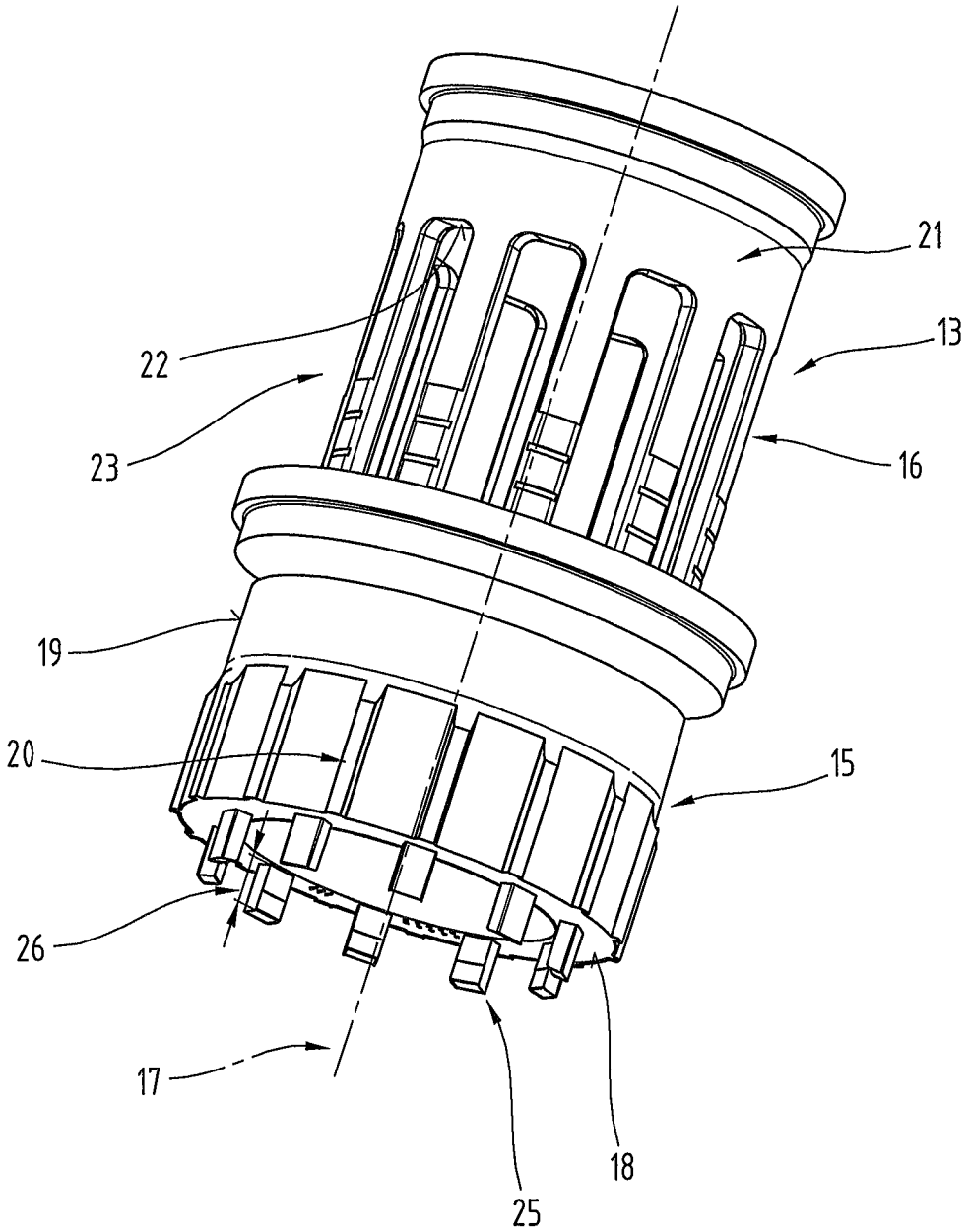
FIG. 2 shows an upper punch in oblique view.

FIG. 2 shows the upper punch 13 in oblique view. Said upper punch 13 comprises a first punch part 15 and a second punch part 16 or consists of the first punch part 15 and the second punch part 16.

The first punch part 15 is designed to be at least approximately cylindrical and comprises an end face pointing downwards in an axial direction 17 which forms a pressing surface 18. In an outer casing surface 19 of the first punch part 15 of the upper punch 13 a plurality of ribs 20 are formed. Said ribs 20 are distributed in particular evenly over the outer periphery of the casing surface 19 of the first punch part 15. Over said ribs 20 the radially outwardly pointing cams 5 of the green compact 1 are formed. In addition, in this way the upper punch 13 can be guided in the press mold during the compacting stroke.

Generally, the form of the first punch part 15 of the upper punch 13 corresponds to the geometry or form of the sintered molded part to be produced and thus to the geometry or the form of said green compact 1 to be produced. The punch part 15 according to FIG. 2 is therefore given as an example and can have a different geometry or form therefrom.

The second punch part 16 of the upper punch 13 also has an at least approximately cylindrical base body 21. On said base bodies 21 on an end face 22 pointing downwards, i.e. in the direction of the first punch part 14, a plurality of fingerlike extensions 23 are arranged. The number of said finger-like extensions 23 and their positioning on the end face 22 correspond to the number and positioning of the undercuts 2 on the green compact 1 (FIG. 1).

As shown best in FIG. 4, the first punch part 15 in axial direction 17 comprises continuous openings 24. The number corresponds to the number of finger-like extensions 23 of the second punch part 16 of the upper punch 13. In each of the openings 24 one of the finger-like extensions 23 is mounted and possibly guided.

Returning to FIG. 2 it can be seen that the finger-like extensions 23 are of a length that their free ends 25 project over the pressing surface 18 of the first punch part 15 of the upper punch 13 in axial direction 17.

Furthermore, preferably the base body 21 of the second punch part 16 is arranged spaced apart from the first punch part 15 so that the finger-like extensions 23 extend between the base body 21 of the second punch part 16 and the first punch part 15, as shown in FIG. 2. It is thus possible that a height 26 of the overhang of the free ends 25 of the finger-like extensions can be adjusted by a relative adjustment of the second punch part 16 relative to the first punch part 15 in axial direction 17.

However, it is also possible that—unlike FIG. 2—the base body 21 of the second punch part 16 is arranged directly next to the first punch part 15 so that the finger-like extensions 23 cannot be seen in this area.

It is also possible that the base body 21 of the second punch part 16 is arranged to dip at least partly into the first punch part 15, for which purpose a suitable recess can be provided in the first punch part 15.

FIG. 3 shows the associated lower punch 14 in oblique view and in an exploded view. The lower punch 14 comprises a first lower punch part 27, a second lower punch part 28 arranged in or insertable into the latter, a third lower punch part 29 arranged in or insertable into the latter and a core rod 30. All of the lower punch parts 27 to 29 and the core rod 30 are designed to be at least approximately cylindrical. As with the upper punch 13 the geometry or the shape of the lower punch 14 can differ from the one in FIG. 3 as the latter corresponds to the geometry or the form of the sintered molded part to be produced and thus the green compact 1.

The core rod 30 extends in axial direction 31 through the lower punch parts 27 to 29 and ends above a pressing surface 32 of the lower punch 14, as can be seen better in FIG. 4. The pressing surface 32 is formed by the end face of the first lower punch part 27 pointing upwards and in axial direction 31.

If necessary, an end plate 33 can be arranged on the core rod 30 in the area of the pressing surface 32. As the powder filling level can be predefined by the position of the core rod 30 it is thus possible to change the filling level simply by changing said end plate 33.

As with the first punch part 15 of the upper punch 13 the first lower punch part 27 on an outer casing surface 34 also comprises a plurality of ribs 35 distributed evenly around the outer periphery of the first lower punch part 27. The ribs 35 preferably also extend only over a portion of the height of the first lower punch part 27 from the pressing surface 32 beginning in axial direction 31. Said ribs 32 are also primarily used for producing the cams 5 of the green compact. Secondarily in this way the lower punch 14 can also be guided in the press mold.

Furthermore, the first lower punch part 27 on an inner casing surface 36 comprises a plurality of grooves 37 distributed evenly around the inner circumference of the first lower punch part 27. The grooves 37 have a longitudinal extension in axial direction 31. The grooves 37 are used on the one hand to form the projections 9 of the green compact 1 according to FIG. 1 and on the other hand to form the undercuts 2 of the green compact 1. The grooves 37 preferably extend over the entire height of the first lower punch part 27 in axial direction 31. Furthermore, the grooves 37 are arranged or formed distributed evenly over the inner circumference of the first lower punch part 27 of the lower punch 14.

It should be noted that the projections 9 do not necessarily need to be provided on the green compact 1, but the angled parts 10 can be formed directly on the web, i.e. in the example embodiment of the green compact 1 according to FIG. 1 can be formed on the annular web **7*a*. The annular web 7*a* is formed by a corresponding annular recess 38 in the area of the pressing surface 32 of the first lower punch part 27. The recess 38 can be provided by a corresponding spacing of the core rod 30 from the inner casing surface 36 of the first lower punch part 27**.

The number of grooves 37 and/or their even distribution around the inner casing surface 36 of the first lower punch part 27 can differ from the embodiment variant of the first lower punch part 27 shown in FIG. 3, as the latter correspond with the respective green compact 1 to be produced. As already mentioned, the green compact 1 according to FIG. 1 is only one possible embodiment variant of a green compact.

The second and the third lower punch part 28, 29 like the second punch part 16 each have an at least approximately cylindrical base body 39, 40. On each of said base bodies 39, 40 finger-like extensions 41 or 42 are arranged, and in particular are connected in one piece with the respective base body 39 or 40.

The number and the location of the finger-like extensions 41, 42 of the second lower punch part 28 or the third lower punch part 29 correspond with that of the finger-like extensions 23 of the second punch part 16 of the upper punch 13.

The undercuts are produced by means of the finger-like extensions 41 of the second lower punch part 28 radially inwardly adjacent to the first lower punch part 27, as explained in more detail in the following.

The projections 9 of the green compact 1 (FIG. 1) are produced by means of the finger-like extensions 42 of the third lower punch part 29 radially inwardly adjacent to the second lower punch part 28.

If the green compact 1 does not have any projections 9 and the angled parts 10 directly adjoin the web (annular web 7*a*), the third lower punch part 29 can be omitted. In this case the lower punch 14 comprises only the first lower punch part 27, the second lower punch part 28 and the core rod 30 or consists of said components.

The second lower punch part 28 can be arranged to be fixed or displaceable in the first lower punch part 27. Furthermore, the third lower punch part 29 can be arranged to be fixed or displaceable in the second lower punch part 28.

The first punch part 15 and/or the second punch part 16 of the upper punch 13 is or are preferably designed in one piece. Likewise, the first lower punch part 27 and/or the second lower punch part 28 and/or the third lower punch part 29 and/or the core rod 30 are designed in one piece.

The production of the undercuts 2 in the green compact 1 (FIG. 1) will be explained in more detail with reference to FIGS. 4 to 6.

It should be noted at this point that according to the method an annular undercut cannot be produced. The method and the device 12 according to the invention are only suitable for producing of undercuts 2 arranged partially around the periphery of the green compact.

FIGS. 4 to 6 each show cross-sections of the device 12 for pressing (compacting) the green compact 1 (FIG. 1). In addition to the upper punch 13 and the lower punch 14 said device 12 comprises at least one die 43 which forms the aforementioned press mold. Furthermore, the device 12 can comprise the usual devices, such as holders, moving devices for the punches and/or the die 43, drive devices, etc., such as those conventionally used for such presses for the production of power-metallurgical components. Therefore, to avoid repetition reference is made to the relevant prior art.

Thus FIG. 4 shows the position of the upper punch 13 relative to the lower punch 14 with a still open, but already filled die 43. FIG. 5 shows the position for the production of the undercuts 2 (FIG. 1) and FIG. 6 shows the pressing position (compaction position).

In a first step a (metal) powder 44 for producing the green compact 1 is filled into a mold cavity 43*a* of the die 43, for example a sintering steel powder, as known from the prior art. The powder 44 is filled up to the upper edge of the core rod 30 or its end plate 33. The finger-like extensions 41 of the second lower punch part 28 are arranged with their free end face at the level of the pressing surface 32 of the first lower punch part 27, so that said free end faces form a plane with the pressing surface 32 of the first lower punch part 27.

However, the finger-like extensions 42 of the third lower punch part 29 are positioned so that their free end faces end below the pressing surface 32 of the first lower punch part 27. In this way the grooves 37 (FIG. 3) in the inner casing surface 36 of the first lower punch part 27 are filled more deeply with powder 44. By means of this position of the finger-like extensions 42 of the third lower punch part 29 the projections 9 of the green compact 1 (FIG. 1) are formed. The finger-like extensions 41 of the second lower punch part 28 are arranged spaced apart from the core rod 30.

After filling the die 43 with powder 44 the closing movement is performed. For this the upper punch 13 is moved downwards and if necessary the lower punch 14 is also moved downwards and/or the die 43 is moved upwards. In this case the finger-like extensions of the second punch part 16 dip into the powder 44, as shown in FIG. 5. By means of this dipping movement a portion of the powder 44 for producing the base body 3 of the green compact 1 is displaced from the plane of the base body 3 downwards into a second plane different from the first plane and in the base body 3 the openings 11 (FIG. 1) are formed. At the same time from the displaced portions of powder 44 the angled parts 10 of the green compact 1 (FIG. 1) are produced. Synchronously with the downwards movement of the fingerlike extensions 23 of the second punch part 16 of the upper punch 13 the second lower punch part 28 moves downwards and thereby supports the portion of powder 44 to be displaced. The displacement of the powder is performed according to the desired width of the undercuts 2 in axial direction 7 (FIG. 1), wherein the degree of the compaction of the powder 44 is taken into consideration.

Lastly, by means of a further downwards stroke movement of the upper punch 13 and/or an upwards movement of the lower punch 14 the powder 4 is compacted, as shown in FIG. 6. The finger-like extensions 23 of the second punch part 16 of the upper punch 13 preferably no longer change their position relative to the first punch part 15 of the upper punch 13. Alternatively or in addition, the finger-like extensions 41 of the second lower punch part 28 of the lower punch 14 preferably also no longer change their position relative to the first lower punch part 27 of the lower punch 14. The finger-like extensions 23 and the finger-like extensions 41 can however be moved towards one another as necessary, in order to achieve an additional compaction of the angled parts 10, i.e. a greater compaction of the powder 44 compared to the compaction of the base body 3 of the green compact 1. In addition, the finger-like extensions 23 can be moved downwards and/or the finger-like extensions 41 can be moved upwards so that the distance between said extensions 23, 41 is reduced in axial direction of the device 12.

Alternatively, by means of a suitable movement of the finger-like extensions 23 and/or the finger-like extensions 41 the distance between said extensions 23, 41 when compacting the powder 44 can be increased so that the angled parts 10 are compacted less than the base body 3 of the green compact After compacting the powder 44 the green compact 1 can be ejected. For this the upper punch 13 is moved upwards and/or the die 43 is moved downwards so that the mold cavity of the die 43 is released. Then the green compact 1 can be ejected by an upwards movement of the lower punch 14 and/or a further downwards movement of the die 43.

Preferably, a stationary die is used.

It should also be mentioned that the upper punch 13 or the lower punch 14 are fixed onto an upper punch mount 45 or a lower punch mount 46. For this corresponding flanges 47, 48 are provided on the first punch part 15 of the upper punch 13 and the first lower punch part 27 of the lower punch 16 on their outer casing surfaces 19, 34, as shown in particular in FIG. 4.

The second punch part 16 of the upper punch 13 can also be secured by a corresponding flange 49 onto the upper punch mount 45 or a separate die mount. In this way, the position of the second punch part 16 relative to the first punch part 15 of the upper punch 13 is fixed in axial direction.

It is also possible for the second punch part 16 of the upper punch 13 to be fixed in the first punch part 15.

If the second punch part 16 of the upper punch 13 is secured to a separate punch mount, it is also possible that said punch mount is provided with its own drive, for example a hydraulic drive, so that the position of the second punch part 16 relative to the first punch part 15 of the upper punch 13 can be changed in axial direction prior to and/or during the pressing of the powder 44. The finger-like extensions 23 of the second punch part 16 can thereby act in the manner of a slide.

It is also possible for all of the undercuts 2 to have the same width in axial direction 7 of the green compact 1 (FIG. 1). Furthermore, it is also possible to design at least some of the undercuts to have a different width. In addition, the finger-like extension 23 of the second punch part 16 of the upper punch 13 and/or the fingerlike extension 41 of the second lower punch part 28 of the lower punch 14 can be configured to have different lengths. If the extensions 23 and/or the extensions 42 are designed to move individually it is also possible that this is achieved by a different provision of the extensions 23 and/or the extensions 42.

It is also possible that at least some of the lower punch parts 28, 29 and/or the second punch part 16 of the upper punch 13 are designed to have stops for delimiting the movement in axial direction 31 or 17, and said parts of the punches can be provided on their outer casing surfaces for example with flanges, as shown for example from FIGS. 2 and 3.

Alternatively or in addition to this the finger-like extensions 23 of the second punch part 16 of the upper punch 13 can have a cross-sectional tapering, as shown in FIG. 4. In this way a stop is also reached for delimiting the relative displaceability of the second punch part 16 relative to the first punch part 15 of the upper punch 13.

The same applies to the finger-like extensions of the second lower punch part 28 of the lower punch 14, as also shown in FIG. 4.

In addition by means of the dimension of the length of the ribs 20 and/or the ribs 35 the adjustability of the upper punch 13 and/or the lower punch 14 is delimited relative to the position relative to the 43.

The main principle of the invention defined above is that at least one undercut 2 can be produced in a green compact 1, in that a portion of the powder 44 to be pressed (compacted) is displaced by a punch (the second punch part 16) out of a first plane of the die 43 forming an opening 11 in the first plane in pressing direction into a second plane of the die 43 different from the first plane. In this case an additional punch (the second lower punch part 28) is supportive during the displacement of the portion of powder 44. The portion of powder 44 to be displaced is pushed downwards by the punch (the second punch part 16) and supported by the additional punch (the second lower punch part 28) so that the powder 44 preferably does not fall down freely. Preferably, the punch and the additional punch move synchronously.

Within the scope of the invention it is also possible to reverse the movement so that the at least one undercut 2 is produced by displacing the portion of powder 44 upwards. In this way it is also possible that the displacement is performed by only one punch (part), i.e. without the support of a second punch (part).

FIGS. 2 and 3 show transverse channels on the finger-like extensions 23. The latter can be arranged optionally on the finger-like extensions 23. By means of said transverse channels the fit of the die can be improved. Furthermore, by means of said transverse channels the cleaning can be performed automatically by scraping.

As a point of formality it should also be noted that for a better understanding of the structure of the device 12 the latter and its components have not been represented true to scale in part and/or have been enlarged and/or reduced in size.

LIST OF REFERENCE NUMERALS

1 green compact
2 undercut
3 base body
4 end face
5 cam
6 radial direction
7 axial direction
7*a* annular web
8 end face
9 projection
10 angled part
11 opening
12 device
13 upper punch
14 lower punch
15 punch part
16 punch part
17 direction
18 pressing surface
19 casing surface
20 rib
21 base body
22 end face
23 extensions
24 opening
25 end
26 height
27 lower punch part
28 lower punch part
29 lower punch part
30 core rod
31 direction
32 pressing surface
33 end plate
34 casing surface
35 rib
36 casing surface
37 groove
38 recess
39 base body
40 base body
41 extension
42 extension
43 die
43*a* mold cavity
44 powder
45 upper punch mount
46 lower punch mount
47 flange
48 flange
49 flange

The invention claimed is:

1. A method for pressing a green compact comprising:

(a) filling a sintering powder into a mold cavity of a die, (b) pushing out of a first plane of the die into a second plane of the die different from the first plane a portion of the sintering powder such that an undercut and a gap are formed, (c) compressing by at least one punch the sintering powder including the portion of the sintering powder in the second plane to form a green compact having a base body, and at least one projection on the base body, and the undercut, the base body having the gap, and the at least one projection extending in an axial direction and having an end, wherein the at least one projection comprises an angled part, the angled part having a cross-sectional area viewed in the axial direction, wherein the gap in the base body of the green compact is in the axial direction in the first plane in a pressing direction perpendicular to the first plane and the second plane, wherein the gap is formed as viewed in the axial direction in an alignment of the angled part in the base body, the gap having a cross-sectional area, and wherein the cross-sectional area of the gap has, viewed in the axial direction, an identical shape and size as the cross-sectional area of the angled part in the axial direction.

2. The method as claimed in claim 1, wherein the portion of sintering powder pushed into the second plane is compacted to a greater degree than the remaining sintering powder.

* * * * *